United States Patent [19]

Reichmann et al.

[11] Patent Number: 4,930,923

[45] Date of Patent: Jun. 5, 1990

[54] COSMETIC APPLICATOR

[75] Inventors: Charles Reichmann, Kew Gardens; Bhupinder S. Kalsi, Plainview, both of N.Y.

[73] Assignee: DRI Mark Products, Inc., Port Washington, N.Y.

[21] Appl. No.: 274,723

[22] Filed: Nov. 9, 1988

Related U.S. Application Data

[63] Continuation of Ser. No. 25,568, Mar. 13, 1987, abandoned, which is a continuation-in-part of Ser. No. 897,599, Aug. 18, 1986, abandoned.

[51] Int. Cl.[5] ..... A46B 11/00; A46B 11/04

[52] U.S. Cl. ..... 401/278; 401/151; 401/205; 401/279; 401/288

[58] Field of Search ..... 401/278, 279, 288, 205, 401/115, 151, 206

[56] References Cited

U.S. PATENT DOCUMENTS

| | | | |
|---|---|---|---|
| 371,899 | 10/1887 | Osborne | 401/278 X |
| 862,630 | 8/1907 | Garvey et al. | 401/279 X |
| 950,074 | 2/1910 | Miller | 401/279 |
| 1,184,662 | 5/1916 | Semple | 401/288 X |
| 1,326,356 | 12/1919 | Lopez | 401/288 |
| 1,376,702 | 5/1921 | Kellogg | 401/279 |
| 1,470,903 | 10/1923 | Ahlering | 401/279 |
| 1,505,442 | 8/1924 | Stephens | 401/278 X |
| 1,651,674 | 12/1927 | Collins | 401/279 |
| 1,940,002 | 12/1933 | Martin et al. | 401/278 |
| 2,425,143 | 8/1947 | Brubaker | 401/151 |
| 2,630,593 | 3/1953 | Jockers | 401/115 |
| 4,043,681 | 8/1977 | Funahashi | 401/206 X |

FOREIGN PATENT DOCUMENTS

| | | | |
|---|---|---|---|
| 323242 | 7/1920 | Fed. Rep. of Germany | 401/278 |
| 933308 | 12/1947 | France | 401/288 |
| 1092389 | 4/1955 | France | 401/288 |
| 66773 | 9/1943 | Norway | 401/278 |
| 13939 | of 1912 | United Kingdom | 401/278 |
| 476182 | 12/1937 | United Kingdom | 401/288 |

*Primary Examiner*—Steven A. Bratlie

*Attorney, Agent, or Firm*—Bauer & Schaffer

[57] ABSTRACT

A barrel shaped holder defines a fluid reservoir and is provided with an applicator at its front and a plug at its rear end. A valve independent of the applicator is interposed between the reservoir and the applicator, and is arranged to be in normally closed condition and opened by an actuator which extends through the reservoir in abutment with both the valve and the plug. The plug is flexible and resiient so that manipulation of the plug operates the actuating rod and the valve.

7 Claims, 1 Drawing Sheet

COSMETIC APPLICATOR

This is a continuation of Ser. No. 025,568 filed March 13, 1987, now abandoned, which is a Continuation-In-Part application of Ser. No. 897,599, filed 8/18/86, now abandoned.

BACKGROUND OF THE INVENTION

The present invention relates to a cosmetic applicator instrument for dispensing and applying cosmetic preparations directly to the skin.

In my co-pending U.S. application Ser. No. 897,599 filed August 18, 1986, I disclosed a pen-like applicator for applying highly solvent fluids such as ink, nail polish, lacquer or perfumes in which the applicator comprises a hollow barrel-like body, having a felt tip and a valve structure causing flow of the fluid from the reservoir onto the felt tip where it passes by capillary action through the tip so as to be easily applied to paper or the body of the user. There are, however, many fluids which are of low viscosity or are dispersions of powder and solvent which do not flow readily, and which cannot be used with the applicator of my prior patent application. For example, certain ladies cosmetics such as eye shadows, rouge, make-up base and the like, are generally too heavy to be dispensed by capillary action. Nevertheless, it would be quite advantageous to have a pen-like dispenser somewhat similar to that disclosed in my co-pending application which is easily manipulated, easily handled, and non spillable. It is therefore, the object of the present invention to provide a fluid applicator instrument for low viscous fluids which is simple and easy to use.

It is specific object of the present invention to provide a cosmetic applicator which provides for the flow of the cosmetic from a reservoir to a valve which valve may selectively be operable by the user.

It is another object of the present invention to provide a pocket sized applicator which safely contains the cosmetic being applied, and applies the same without spillage in a safe and effective manner.

It has also been found that the normal application nibs or "brushes" conventionally formed of felt or nylon materials are too rigid and not sufficiently soft to bend and conform to the surface of the body during application of low viscosity cosmetics, particularly eye shadows and the like. The present invention therefore, encompasses the object of providing improved brush type applicators specifically for such use.

The foregoing objects, as well as numerous other objects and advantages will be apparent from the following disclosure of the present invention.

SUMMARY OF THE INVENTION

According to the present invention, a cosmetic applicator instrument is provided having a barrel shaped holder defining a fluid reservoir and an applicator at its front end, a valve independent of the applicator and interposed between the reservoir and the applicator. The valve is arranged to be in normally closed condition and opened solely by means which extend through the reservoir and operable from the exterior of the holder.

Preferably the valve assembly comprises a construction similar to that shown in the aforementioned copending application. However, in accordance with the invention, an actuating rod, axially aligned with the valve, extends through the holder to its rear end. The rear end of the holder comprises a depressible wall which when depressed, pushes the actuating rod forward so as to unseat the valve.

The depressible wall is formed as the end wall of a closure cap secured to the rear end of the holder, which end wall is in the form of a diaphragm having a dome shape and therefore, resiliently and restorably depressible.

In a secondary aspect of the present invention, an improved brush type applicator is provided, allowing for the flow of low viscuous fluids. In one form, the brush applicator comprises an array of bristles constructed about a central tube, through which passage of the fluid is facilitated and in the second embodiment, the brush applicator is formed of a unitary foam sponge applied about the central passage tube.

Full details of the present invention are set forth in the following dsecription in conjunction of the accompanying drawings.

BRIEF DESCRITPION OF THE DRAWINGS

DESCRIPTION OF THE INVENTION

Figures 1, 2, 3, 4:
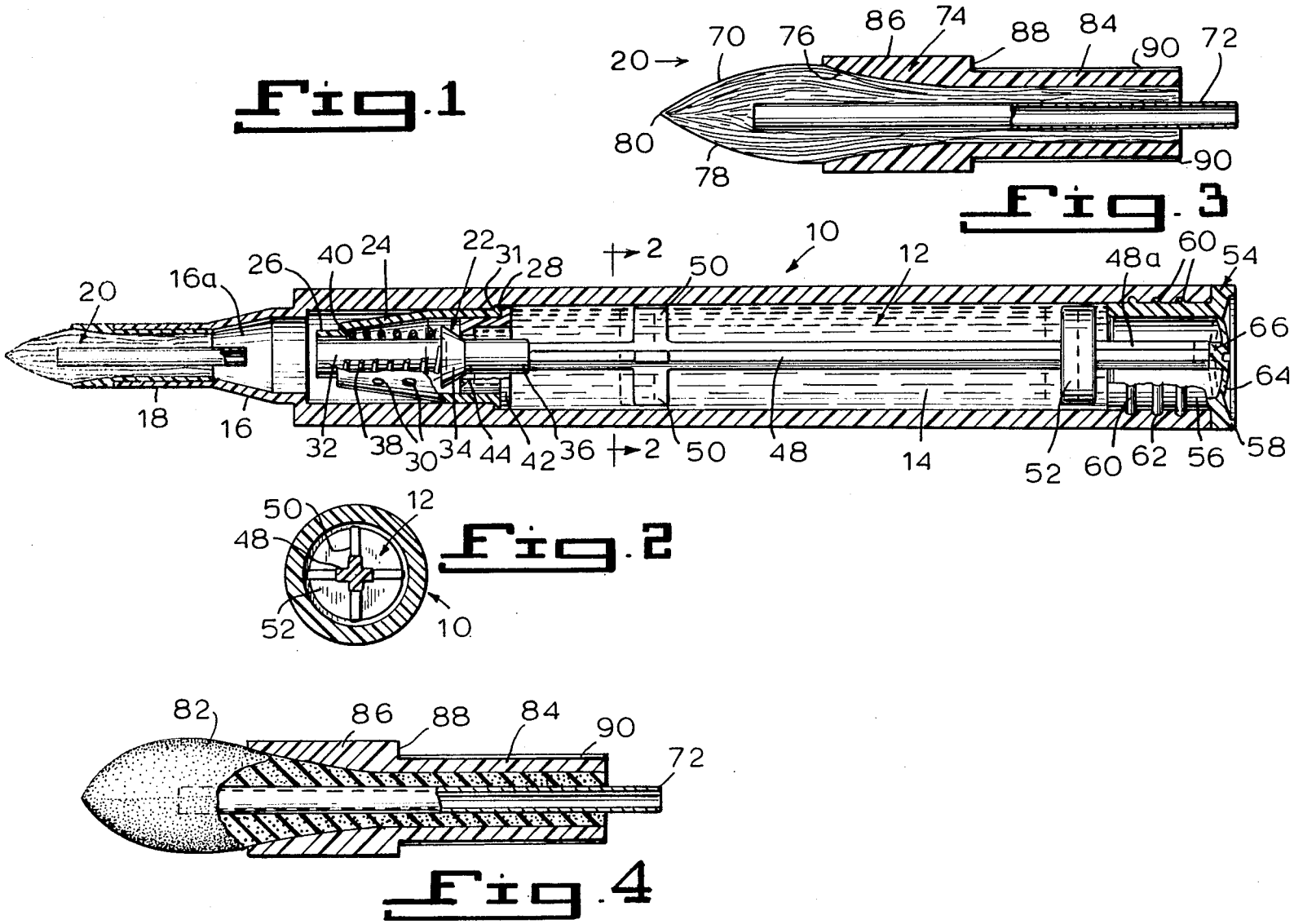
FIG. 1 is a longitudinal sectional view of an instrument for applying low viscous fluids, embodying the present invention.
FIG. 2 is a sectional view taken along line 2—2 of FIG. 1.
FIG. 3 is an enlarged view of the applicator or nib illustrated in the embodiment of FIG. 1.
FIG. 4 is a second embodiment of an applicator or nib which can be employed in the present invention.

As seen in FIG. 1, the applicator of the present invention comprises an elongated tubular barrel shaped holder 10 difining a chamber forming a reservoir 12 adapted to receive and retain a fluid medium 14. The holder 10 is dimensioned so as to be conveniently held in the hand, in the manner of a pen or pencil and is narrowed or tapered at its forward end 16 to terminate in a generally tubular point 18 in which is axially located and which is adapted to fixedly mount an applicator 20 to be described in greater detail hereinafter.

Located within the reservoir chamber 12, immediately to the rear of the hollow point 18, is a valve assembly, generally designated by the numeral 22, which normally occludes passage from the reservoir 12 to the space defined within the taper 16 which thus forms a secondary chamber or reservoir **16*a*. The valve assembly 22 comprises a generally conical body 24 having a narrow tubular guide 26 at its forward end and extending rearwardly to an annular radially extending flange 28 at its rear end. The side wall of the body 22 is provided with slots or holes 30 permitting the flow of liquid radially therethrough. The valve assembly 22 is set and fixed within the holder 10 so that the radially extending flange 28 seats against a shoulder 31 formed on the interior wall of the holder 10. The tubular guide 26 is aligned with although not in contact with, the applicator 20. Slidably located and guided for movement within the tubular guide 26 is a rod shaped plunger 32 having a conical valve head 34, the taper of which is pointed to the rear end of the holder 10 and from which extends a stub 36. A compression spring 38, bears with one end against the base of the conical head 34 and with its other end against an internal shoulder 40 formed by the narrowing of the tubular guide 26. The rear end of the valve body 24 is closed by an annular cup-shaped wall 42 which may be press fit, snugly, into the rear of the body 24 and into abutment with the radially extending flange 28**.

The cup-shaped wall 42 has a central opening through which the stub 36 passes and which forms a valve seat 44 against which the conical valve head 34 is adapted to seat and fluid tightly seal under the bias of the spring 38. The extending stub 36 passes outwardly of the cup 42 toward the rear of the holder 10. Within the reservoir 12, in axial alignment with the stub 36, is an elongated actuating rod 48. The rod 48 is maintained in axial alignment by providing at its forward end, a plurality of radially spaced arms 50 and at its rear end by a disc 52. The spaced arms 50 and the disc 52 are adapted to slidably engage against the inner wall of the holder 10, but otherwise not inhibit movement of the rod 48, which is adapted to move freely within the reservoir.

A small terminal portion **48*a* of the rod 48 extends rearwardly from the disc 52 centrally into a plug 54 comprising a cylindrical wall 56 of relatively thick dimension, having a radially extending flange 58. The cylindrical wall 56 is provided with annular ribs 60 which are adapted to engage within conforming recesses 62 formed on the inner wall of the holder 10 so that once the cap 54 is forced and press-fit into place, it will seat firmly and fluid tightly within and close the end of the holder 10. If desired, suitable means can be employed to permanently adhere and enhance the fluid-tight connection of the annular ribs 60 within the grooves 62. The rear frontal end of the plug 54 is formed of a thin dome shaped flexible diaphragm wall 64, the inner face of which is provided with an enlarged central boss 66, which is aligned and in abutment with the terminal portion 48*a* end of the rod 48**.

The dome shaped wall 64 is relatively elastic, and may be depressed out of its normal inoperative position and into an operative position as shown in the dotted lines in FIG. 1, (inwardly axially of the holder) which in turn causes the corresponding depression and movement of the rod 48, also as shown in the dotted lines. Movement of the rod 48 forwardly will consequently cause the valve head 34 to unseat from the seat 44, allowing the fluid media to pass from the reservoir through the valve body 24 into the secondary reservoir 16a within the taper 16 and then to the applicator 20.

Because the wall 64 is formed of relatively thin material, it has an inherent elastic memory, which when released from manipulation, will automatically flex outwardly restoring both itself and permitting the rod 48 to return to its initial position and shown in full lines. The restoration of the rod 48 and the wall 46 is enhanced by the action of the spring 38 against the valve 34 which is transmitted by rod 48 to the wall 64. It will be noted that the required extent of the movement of the wall 64 and of the rod 48 may be extremely small, depending upon any space that may exist between it and the rod. In practice, the rod 48 takes up almost all of the space between the valve 24 and the wall 64, leaving little play between them.

The dome shaped wall 64 is set below the terminal edge of the flange 56 and within the protective confines of the end of the holder thereby reducing the liklihood that the wall 64 can be inadvertantly pressed by the user, or that it can be depressed by turning the applicator over and tapping the same on its rear end.

The tapered portion 16 of the body 10, is sufficiently large to provide a subsidiary reservoir **16*a* for the fluid, after it passes through the valve 24, so that the applicator is maintained "wet" with cosmetic fluid, avoiding the need to repeatedly or frequently depresses the valve. Although the device shown in FIG. 1 illustrates an improved applicator (see FIGS. 3 and 4) any ordinary and conventional applicator nib, or the like, can be used since sufficient "wetting" of the applicator is afforded from the subsidiary reservoir in the tapered position 16. However, in accordance with the present invention, it is preferred to employ one of the improved brush type applicators illustrated in FIGS. 3 and 4**, for example.

As seen in the detail of FIG. 3, the brush type applicator, shown in FIG. 1, comprises a body formed of fluid transmitting material, such as a group of elongated natural or artificial bristles 70 arranged about a central liquid conducting tube 72 of impervious material such as aluminum or plastic. The tube 72 has a relatively small inner diameter but capable of allowing the flow of the fluid media therethrough. An outer sleeve 74 of impervious plastic or metal is set about the bristles 70, so as to envelope the bristles 70 and the tube 72 in a tight manner, without restricting the flow of the fluid therethrough.

The inner surface of the outer sleeve 74 is tapered as at 76, so as to allow the bristles 70 to flare outwardly and form a tip end 78 tapered to form a conical point 80. On the other hand, the tip end may be shaped in the form of a blade or knife or in any of the conventional brush shapes in accordance with the use to the applicator is used to be placed. For example, if the applicator is to apply eye shadow, the brush may have a straight rather than a conical taper, or a more or less pointed end like a pencil.

The central tube 72 extends rearwardly from the bristle body and sleeve so as to be freely immersed in the fluid found in the subsidiary reservoir **16*a*. Thus fluid tends first to flow into the tube 72 and secondly into the bristles 70. As a result, the fluid is carried directly forward to the tip end 78** of the applicator from which it is dispensed. This eliminates the problem of applying large splotches because of the release of the fluid along the rear of the applicator rather than at the tip.

The second embodiment of the improved applicator brush shown in FIG. 4, provides a central tube 72 covered by a unitary molded foamed plastic sponge body 82 capable of adsorbing the fluid media. This unitary sponge plastic brush may be similarly shaped as the bristle brush and provided with a smooth flaring conically pointed tip, a flat tip or one of the other configuration. The sponge brush of FIG. 4 is provided with an outer sleeve 84 which is identical to that of outer sleeve 74 of the bristle brush so that various applicators may be interchangeable within the point 18 whereby the user may, if desired, exchange and/or replace of applicators, readily.

The sleeves 74 and 84 in either embodiment are provided with two external diameter sections 84 and 86 separated by the shoulder 88. The rear section 84 is of a size adapted to be force fit within the point 18 until stopped by engagement of the shoulder 88. This ensures that applicator 20 remains aligned with but out of contact with the valve assembly as previously explained. The forward or large diameter section 86 may be larger than the external diameter of the point 18 although is preferable it should not be. Preferably, the outer surface of the rear section 84, is provided with several uniformly spaced longitudinal grooves 90 which, in combination with the enclosing body 18, provides vents for air flow into the subsidiary reservoir to enhance the free flow of fluid.

Various changes, modification and embodiments have been described, and others will be apparent to those skilled in this art. Accordingly, it is intended that the disclosure be taken as illustrative of the invention and not limiting its scope.

What is claimed is:

1. An instrument for applying a fluid cosmetic to the surface of the skin of a user comprising a tubular holder defining a reservoir for retaining a supply of the fluid cosmetic, an applicator removably mounted in the front end of said holder and an end wall closing the rear end of said holder, a valve dividing said reservoir into a primary chamber at the rear of said holder and a secondary chamber at the front of said holder, said valve being normally biased in a closed position to occlude the flow of fluid cosmetic from said primary chamber to said secondary chamber and means extending rearwardly through said primary chamber for moving said valve from its normally closed position to permit flow of liquid media from said primary chamber, said valve including a hollow perforated body surrounding said valve and forming an intermediate chamber by which said liquid media is inhibited in its flow into said secondary chamber, said applicator comprising a body formed of fluid transmitting material having a forward tip end for applying the fluid to the skin of the user and a rear end for contact with the fluid in the secondary chamber, a hollow impervious tube inserted within said body having its front end spaced from the tip end of said body and its rear end extending outwardly from the rear end of said body and an impervious sleeve surrounding said body substantially along its length to secure said body and tube into a cohesive unit, said sleeve of said applicator having an outer surface of a diameter conforming to that of the inner diameter of the front end of said holder said sleeve being removably insertable in said front end of said holder to close the front end of said secondary chamber and space said hollow impervious tube from and out of contact with said valve, at least one of the outer surfaces of said sleeve and the inner surface of the front end of said holder having formed thereon grooves extending from end to end between said holder and said sleeve providing vents for passage of air to and from said secondary chamber.

2. The brush according to claim 1 wherein the inner surface of said sleeve is flared radially outward at its front end, and said body of fluid transmitting material is flare-shaped to conform to said inner surface and narrowed to form said forward tip thereon.

3. The brush according to claim 2 wherein said body if formed of bristles.

4. The brush according to claim 2 wherein said body is formed of sponge.

5. An instrument for applying a fluid cosmetic to the surface of the skin of a user comprising a tubular holder defining a reservoir for retaining a supply of the fluid cosmetic, an applicator removably mounted in the front end of said holder and an end wall closing the rear end of said holder, valve assembly comprising a wall dividing said reservoir into a primary chamber at the rear of said holder and a secondary chamber at the front of said holder, said dividing wall having an open valve seat therein, a valve head and a foraminous body surrounding said valve head and forming an intermediate chamber within said secondary chamber for retarding the flow of fluid into said secondary chamber means for removeably closing said head onto said seat, comprising spring means in abutment with said head for normally biasing said head onto said seat, means for manually removing said head from said seat including an actuating rod aligned axially within and extending freely through said primary chamber and having one end separably abutting said head in opposition to the bias of said spring means and the other end separably abutting the rear end wall, said rear end wall comprising a plug insertable in said holder and means at the rear end of the holder in alignment with said actuating rod being manually depressed to effect conjoint movement of said actuating rod to move said head from said seat and permit flow of fluid cosmetic from said primary chamber to said secondary chamber and on manual release to permit said biased head to return to its normal closed position.

6. The instrument according to claim 5 wherein said foraminous body is located axially within said holder supporting said valve head in the form of a reciprocable plunger, said foraminous body having a rear end wall with an opening defining the valve seat cooperable with said valve head to occlude passage of fluid from between said reservoir and applicator, first spring means mounted in said foraminous body biasing said plunger rearwardly so that said valve head normally seats against said valve seat, said actuating rod aligned with the opening in the rear wall of said body and extending through said holder and terminating at the rear end of said holder, said foraminous body enabling passage of fluid therethrough into said secondary chamber and being formed at its forward end with a support having a bore in which the forward end of said plunger is slideably supported, said actuating rod being adapted to engage said valve head and unseat the same to permit the flow of liquid from said reservoir to said applicator without contact of said valve head or plunger with said applicator.

7. The instrument according to claim 6 wherein said manually depressible means comprises a flexible diaphragm occluding the rear end of said holder and normally having a self-restoring dome shape, said plug being set within the end of said holder so that the dome of said diaphragm is directed axially outwardly of said holder within said holder below the frontal end thereof, said diaphragm being manually deflectible from said normal dome shape to effect conjoint movement of said actuating rod.

* * * * *